US006687475B2

(12) United States Patent
Kacinski et al.

(10) Patent No.: US 6,687,475 B2
(45) Date of Patent: Feb. 3, 2004

(54) MEANS AND METHOD OF INSTALLING TONER SEALS

(75) Inventors: Robert Kacinski, Sayville, NY (US); Mark Simko, Franklin Square, NY (US)

(73) Assignee: Lester E. Cornelius, Oyster Bay, NY (US)

( * ) Notice: Subject to any disclaimer, the term of this patent is extended or adjusted under 35 U.S.C. 154(b) by 0 days.

(21) Appl. No.: 10/369,029

(22) Filed: Feb. 20, 2003

(65) Prior Publication Data

US 2003/0202816 A1 Oct. 30, 2003

Related U.S. Application Data

(60) Provisional application No. 60/374,757, filed on Apr. 24, 2002.

(51) Int. Cl.[7] ..... G03G 15/08
(52) U.S. Cl. ..... 399/106; 399/102
(58) Field of Search ..... 222/DIG. 1; 399/102, 399/105, 106, 119, 262, 263

(56) References Cited

U.S. PATENT DOCUMENTS 5,296,902 A * 3/1994 Michlin ..... 399/106
6,585,848 B2 * 7/2003 Chadani et al. ..... 399/106

FOREIGN PATENT DOCUMENTS

JP 06-200378 * 9/1987

* cited by examiner

*Primary Examiner*—Hoang Ngo
(74) *Attorney, Agent, or Firm*—Charles E. Temko

(57) ABSTRACT

A means and method for installing a seal upon the mouth of an elongated opening in a toner hopper farming part of a cartridge used with photoelectric copying devices. The tool is configured to support the seal along its axial length while exposing a distal edge portion of a peripherally located adhesive enabling it to be positioned on a corresponding edge surface of the toner hopper opening and engaged therewith, following which the tool is disconnected from the seal to enable the remaining portions of the adhesive to be adhered to the remaining portions of the mouth of the seal.

3 Claims, 3 Drawing Sheets

MEANS AND METHOD OF INSTALLING TONER SEALS

RELATED APPLICATION

Reference is made to our co-pending provisional application, Ser. No. 60/374,757, filed Apr. 24, 2002, to which a claim of priority is made.

BACKGROUND OF THE INVENTION

This invention relates to the field of electrophotographic printers employing replaceable toner cartridges which are containers holding a supply of toner particles. The toner is fed, by various means, to the development section of the printer. The toner is in powder form that typically has a particle size ranging from 5 microns to 20 microns. The toner is designed to flow freely, which makes it difficult to contain in the toner cartridge during shipping without a seal completely covering the opening. The seals must be able to withstand the rigors of transport and be easily removed by the end user of the cartridge.

Printer cartridges are designed to be compact. As a rule, many toner cartridges have very narrow, openings to the integral toner hopper which makes either manual or automatic seal placement difficult. Many seats use a pressure-sensitive adhesive. When the pressure-sensitive adhesive is exposed prior to insertion, it tends to make placement difficult while maneuvering in a restricted opening, particularly in a manual seal insertion process.

There have been various designs to make such seals easier to insert over the toner cartridge opening. One construction includes a removable cardboard strip with perpendicular tabs on the top surface of the seal. This design provides a rigid support for the seal and a means to grasp the seal for insertion. The disadvantage accompanying this design is that it is still difficult to maneuver the seal into position with the adhesive fully exposed, and it is even more difficult in a manual process in toner cartridges having very narrow access openings. It is not possible to see the whole position of the seal as it is installed because the seal is held by hand, and the hand blocks the view.

The present invention relates to a rigid, removable, extended insertion tool which has a release coating on a surface which engages a portion of the peripherally located adhesive on the seal. The remainder of the adhesive, in this position, is exposed, so that when the seal is inserted in the cartridge to be positioned above the toner opening, a distal portion of the adhesive may be first engaged, following which the tool is disengaged from the seal, and the seal is allowed to drop to the surrounding remaining portion of the toner opening, thus completing the installation. The tool is sufficiently durable that it may be reused many times.

The tool may be made of rigid material such as plastic or metal, and is of length slightly smaller than the length of the seal to be installed. It is also slightly wider than the toner cartridge opening, so that the end portions may extend beyond the toner cartridge opening. It is preferable to place a physical stop on the planar portion of the tool which forms a shoulder so that the seal may be positioned on the planar portion of the tool with the correct amount of seal overhang leaving a distal portion of the adhesive exposed for initial positioning on a distal edge of the toner hopper opening.

The installation process is to first remove the seal release liner covering the pressure-sensitive adhesive. The seal may then be placed on the planar portion of the tool having the release coating. The tool and seal are then inserted into the toner cartridge opening so that the exposed adhesive of the seal is positioned on the distal edge of the toner cartridge opening. That part of the seal is pressed down to adhere the seal to the distal edge of the opening. The tool is then removed by moving the distal edge downwardly to peel the engaged adhesive of the seal away from the release coating on the tool.

SUMMARY OF THE INVENTION

Briefly stated, the invention contemplates the provision of a novel tool and method for installing a known toner seal on the mouth of a toner hopper opening wherein the tool detachably supports the seal during positioning in such a manner the a distal portion of the peripheral adhesive surface of the seal overlies a corresponding distal portion of a surface surrounding the toner hopper opening so that the adhesive surface may be engaged while the seal is still supported by the tool, using an elongated probe if necessary to press the adhesive into place. The seal is then detached from the tool so that the proximal portion of the adhesive surface may drop to engage a corresponding surface surrounding the toner opening, again using the auxiliary probe, if necessary. Once detached, the tool may be reused.

BRIEF DESCRIPTION OF THE DRAWINGS

In the drawings, to which reference will be made in the specification, similar reference characters have been employed to designate corresponding parts throughout the several views.

DETAILED DESCRIPTION OF THE DISCLOSED EMBODIMENT

Figure 1:
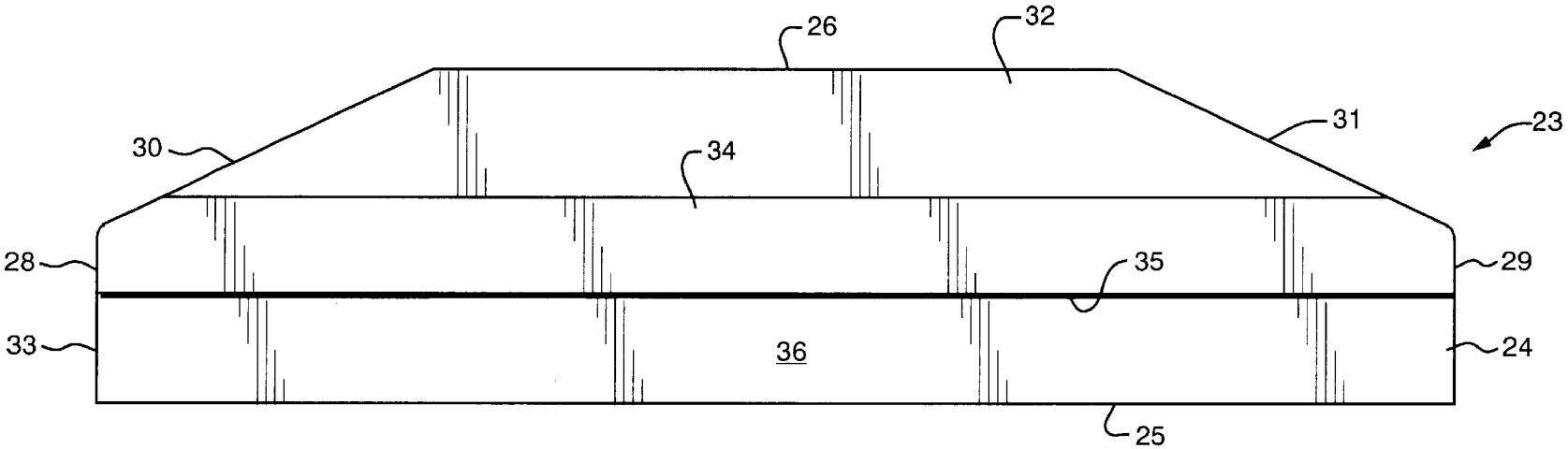
FIG. 1 is a side elevational view of a seal installation tool forming part of the disclosed embodiment.

With reference to the drawing, reference character 10 indicates a known flexible toner cartridge seal having a main body 11 formed from metallic foil, and bounded by an upper surface 12, a lower surface 13, longitudinal edges 14 and 15, end edges 16 and 17, tear strip reinforcements 18 and 19, and a flexible tear strip 21 which when pulled after installation, opens the seal. The undersurface adjacent the longitudinal edges 14 and 15 are provided with a suitable pressure-sensitive adhesive, as is known in the art, such edges being hereinafter being referred to as distal and proximal, respectively, with respect to the access opening in the cartridge (not shown).

Referring to FIG. 1, there is illustrated in detached form an installation tool 23 as described hereinabove. The tool includes a main body 24 of planar material such as synthetic resin or metal, bounded by an inner edge 25, an outer edge 28, side edges 28 and 29, tapered edges 30 and 31. A manually-engageable portion 32 is located adjacent a seal-engaging portion 33 defined by a raised guide 34 having an outer edge 35 defining a shoulder. A seal-engaging surface 36 includes a release coating, typically of silicon type, which enables the engagement of the proximal portion of the pressure-sensitive adhesive while allowing easy disengagement once a portion of the adhesive has been engaged along the distal edge of the mouth of the seal.

Figure 2:
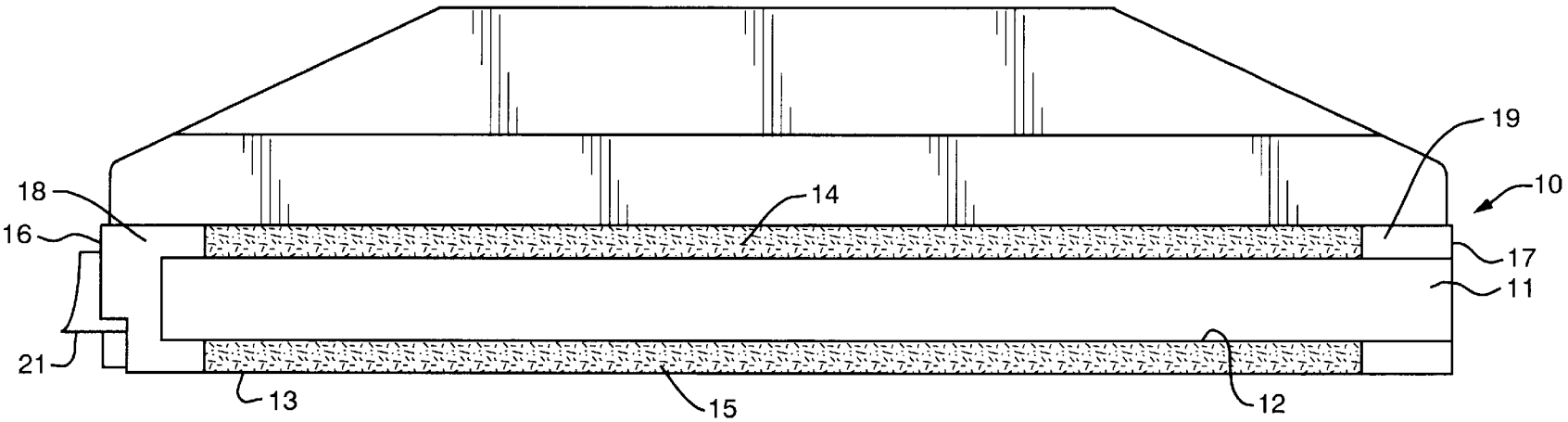
FIG. 2 is a corresponding side elevational view showing the engagement of the tool with a known toner seal.

Installation of the seal will be apparent from a consideration of the drawing. Once the toner cartridge has been thoroughly cleaned and all traces of a previous seal removed, the replacement seal is positioned as shown in FIG. 2 wherein the distal edge of the adhesive projects beyond the inner edge 25 (after the original protective silicon release paper has been removed), and the tool and seal together are inserted into the opening of the toner cartridge to a point where the seal directly overlies the toner hopper opening. This position will normally be detected by observing the end edges of the tool which will normally extend outwardly of the toner cartridge access opening.

At this point, the exposed surface of the adhesively coated distal edge of the seal may be positioned in engagement with the toner hopper surface surrounding the toner opening, using an elongated probe, if necessary, to securely place all of the adhesive in contact. At this point, the seal is sufficiently anchored in position that the tool may be removed. This is accomplished by slightly downwardly angling the plane of the tool wherein the release surface engaging the proximal adhesive edge surface of the seal disconnects, permitting the tool to be withdrawn. Again, using the probe, if necessary, the remaining portions of the adhesive are affixed to the surface surrounding the toner opening to complete installation.

As distinguished from prior art constructions which employ a removable and discardable reinforcement the planar body of the tool properly supports the otherwise flexible seal to maintain it in planar condition for installation, thus effectively reducing the cost of production of the seal. While initially somewhat more expensive than a cardboard reinforcement, the tool, by virtue of its configuration, provides positioning of the seal far more accurately than could be accomplished using manual guidance alone.

Figure 3:
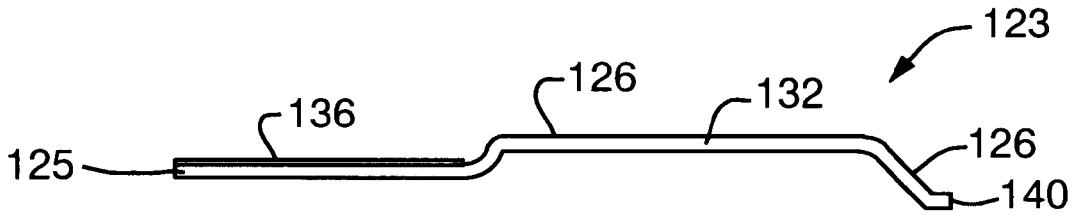
FIG. 3 is an end elevational view of an alternate form of the embodiment.

Turning now to the alternate form of the embodiment illustrated in FIG. 3, parts corresponding to those of the principal form have been designated by similar reference characters with the additional prefix "1".

The alternate form 110 differs from the principal form in that it is formed substantially of relatively thin gauge synthetic resinous material, and may be extruded to be cut into convenient lengths depending upon the width of the toner opening in the toner cartridge. It includes an angularly disposed flange 140 to provide necessary rigidity which supports the seal.

We wish it to be understood that we do not consider the invention to be limited to the precise details of structure shown and set forth in the specification, for obvious modifications will occur to those skilled in the art to which the invention pertains.

We claim:

1. A means for installing a flexible seal to cover an elongated dispensing opening in a toner hopper forming part of a replaceable cartridge used in an electrophotographic copier and similar reproductive devices, said seal having a first surface having an adhesively coated peripheral portion adapted to dose said dispensing opening, and a second surface which is not coated with adhesive, said means comprising a planar tool selectively insertable within said cartridge to overlie said dispensing opening, said tool having a releasable surface engaging a proximal portion of an adhesive surface of said seal as a distal portion of said seal is positioned and engaged with a corresponding edge surface of said toner dispensing opening, said tool being subsequently disengaged from said seal to position and engage said proximal portion of said adhesive with a corresponding edge surface of said opening.

2. A means in accordance with claim 1, said releasable surface of said tool having a proximal edge, and a guiding strip forming a shoulder at said proximal edge.

3. The method of installing a flexible elongated seal over the mouth of a toner hopper opening forming part of a toner cartridge in a photoelectric copier and similar devices, said seal having a non-adhesive surface and an oppositely disposed adhesive peripheral edge surface corresponding to a surface of said hopper surrounding said opening comprising the steps of:

a) providing an elongated installation tool corresponding in length to that of said seal, said tool having an adhesive releasing surface corresponding to the length of the seal, and of width less than that of said seal;

b) placing said seal upon said adhesive-releasing surface such that a distal portion of said peripheral edge surface Is exposed, and a proximal portion of said peripheral edge surface is in contact with said adhesive-releasing surface;

c) inserting said tool and seal into said toner cartridge to overlie said toner hopper opening, and engaging said distal portion of said adhesive of said seal with a peripheral surface surrounding said hopper opening;

d) separating said adhesive releasing surface of said tool from said proximal portion of said adhesive;

e) withdrawing said tool from said cartridge to expose said proximal portion of said adhesive; and f) engaging said proximal portion of said adhesive with a proximal surface surrounding said toner opening.

* * * * *